US010479567B2

(12) United States Patent
Therrien et al.

(10) Patent No.: US 10,479,567 B2
(45) Date of Patent: Nov. 19, 2019

(54) DRINK CONTAINER WITH TORQUE-LIMITING LID

(71) Applicant: NUK USA LLC, Tarrytown, NY (US)

(72) Inventors: Peter Therrien, Blue Bell, PA (US); Richard Rubin, Fairfield, NJ (US); Mario A. Turchi, Tenafly, NJ (US); Steven Madsen, New York, NY (US)

(73) Assignee: NUK USA LLC, Tarrytown, NY (US)

( * ) Notice: Subject to any disclaimer, the term of this patent is extended or adjusted under 35 U.S.C. 154(b) by 168 days.

(21) Appl. No.: 15/669,360

(22) Filed: Aug. 4, 2017

(65) Prior Publication Data

US 2019/0039790 A1 Feb. 7, 2019

(51) Int. Cl.

| | |
|---|---|
| ***B65D 47/06*** | (2006.01) |
| ***B65D 45/32*** | (2006.01) |
| ***B65D 43/02*** | (2006.01) |
| ***B65D 51/24*** | (2006.01) |
| ***A61J 9/08*** | (2006.01) |
| ***A61J 11/00*** | (2006.01) |
| ***A61J 11/04*** | (2006.01) |
| *B65D 53/02* | (2006.01) |

(52) U.S. Cl.

CPC ..... *B65D 45/325* (2013.01); *A61J 9/085* (2013.01); *A61J 11/006* (2013.01); *A61J 11/045* (2013.01); *B65D 43/0231* (2013.01); *B65D 47/06* (2013.01); *B65D 51/248* (2013.01); *A61J 2205/70* (2013.01); *B65D 53/02* (2013.01); *B65D 2543/00046* (2013.01); *B65D 2543/00537* (2013.01)

(58) Field of Classification Search

CPC .. B65D 45/325; B65D 43/0231; B65D 47/06; B65D 51/248

USPC ..... 220/705

See application file for complete search history.

(56) References Cited

U.S. PATENT DOCUMENTS

| | | | | |
|---|---|---|---|---|
| 3,797,688 | A | 3/1974 | Porcelli et al. | |
| 4,351,442 | A | 9/1982 | Summers | |
| 4,453,388 | A | 6/1984 | Baker et al. | |
| 4,527,406 | A | 7/1985 | Baker | |
| 4,830,058 | A | 5/1989 | Harris | |
| 5,147,066 | A | 9/1992 | Snider | |
| 5,433,329 | A | 7/1995 | Weinstein | |
| 7,624,889 | B2 | 12/2009 | Tharp et al. | |
| 7,988,003 | B1 * | 8/2011 | Clodfelter ..... | B65D 50/041 215/220 |
| 8,256,642 | B2 | 9/2012 | McNamara et al. | |

(Continued)

*Primary Examiner* — King M Chu

(74) *Attorney, Agent, or Firm* — Eversheds Sutherland (US) LLP

(57) ABSTRACT

A drink container with torque-limiting lid is provided. The drink container includes a lid that can be threadably coupled to a container body having a volume to hold fluids. The lid can include an inner lid assembly concentric with an outer lid assembly. The inner lid assembly can include a multiple ratchet teeth along an outer perimeter and the outer lid assembly can include one or more ratchet pawls along an inner perimeter and configured to engage the ratchet teeth. Rotational force on the outer lid assembly can be transferred to the inner lid assembly from the ratchet pawls to the ratchet teeth to threadably couple the inner lid assembly to the container body. Once a torque limit is reached, the ratchet pawls can slip along the ratchet teeth preventing further tightening of the inner lid assembly to the container body.

14 Claims, 5 Drawing Sheets

(56) References Cited

U.S. PATENT DOCUMENTS

| | | | | |
|---|---|---|---|---|
| 8,733,568 | B2 | 5/2014 | Dunn et al. | |
| 8,739,993 | B2 | 6/2014 | Dunn et al. | |
| 8,857,638 | B2 * | 10/2014 | Brozell ..... | B65D 50/041 215/219 |
| 9,144,337 | B2 | 9/2015 | Chan | |

* cited by examiner

DRINK CONTAINER WITH TORQUE-LIMITING LID

FIELD OF THE DISCLOSURE

The present disclosure is generally directed to liquid containers, and more particularly to a children's drink container that includes a torque limiting lid system.

BACKGROUND

Conventional drink containers for children, such as training cups or sippy cups, typically include a drink container with a removable lid. The removable lid can include a hard plastic drinking spout or soft, at least partially pliable, drinking spout that the child can use to access the liquids stored within the drink container.

Conventional removable lids can include an inner threaded section that is used to threadably couple the lid to the top of the drink container. On problem that has developed is that the connection between the removable lid and the drink container can leak if the removable lid is not properly seated and coupled to the drink container. In an effort to try and limit the amount of leaking that may occur, consumers have learned to try and tighten the lid as much as possible to the drink container to improve the seal between the lid and the drink container.

In an effort to reduce the risk of leaking between the lid and the drink container, some conventional removable lids can also include a sealing gasket that is designed to engage the top of the drink container to provide additional protection against leakage between the drink container and the lid. However, these sealing gaskets can fail to operate over time if the lid is improperly coupled to the drink container, such as by excessive tightening of the lid to the drink container. As the sealing gasket begins to fail, the consumer will continued to try and tighten the lid to the drink container at even higher torque levels, thereby further damaging the sealing gasket. Providing a lid that allows the consumer to tighten the lid to the drinking container as the proper torque level without over-tightening the lid and damaging the sealing gasket will improve the durability of the sealing gasket and increase the useful life of the drink container.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION OF THE EXAMPLE EMBODIMENTS

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical, elements throughout.

Certain dimensions and features of the example drink container and/or torque-limiting lid are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships between dimensions of the drink container and/or torque-limiting lid and between features of the drink container and/or torque-limiting lid are described herein using the term "substantially." As used herein, the terms "substantially" and "substantially equal" indicates that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom.

As used herein, the term "substantially orthogonal" indicates that the perpendicular relationship is not a strict relationship and does not exclude functionally similar variations therefrom.

Figure 1B:
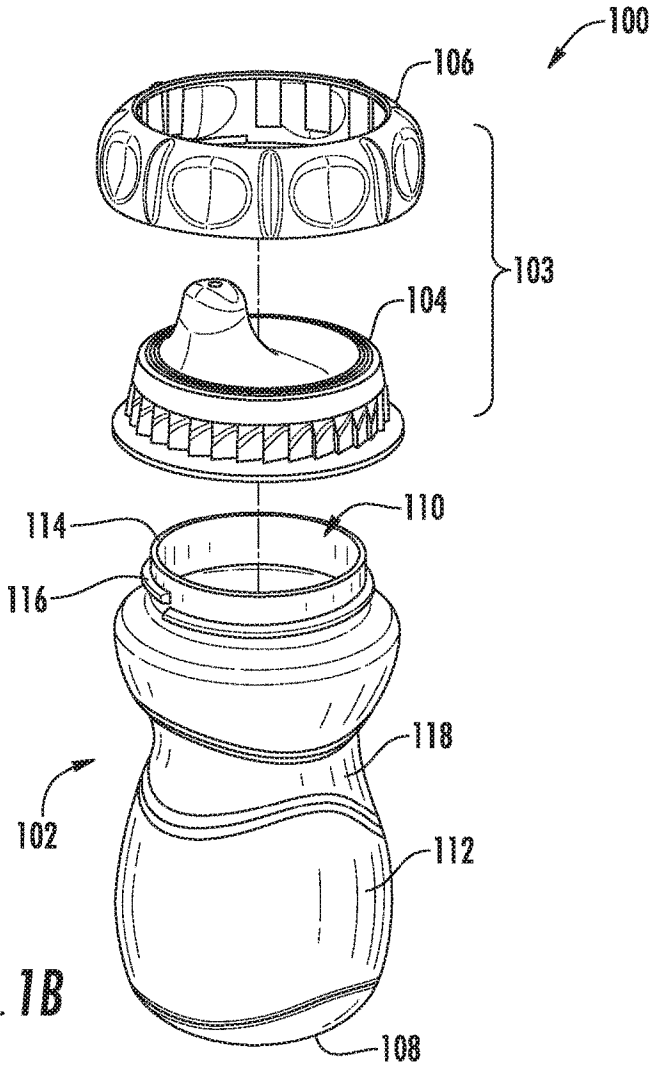
FIG. 1B is an exploded view of the drink container and torque-limiting lid of FIG. 1A, in accordance with one example embodiment of the disclosure.
Figure 1A:
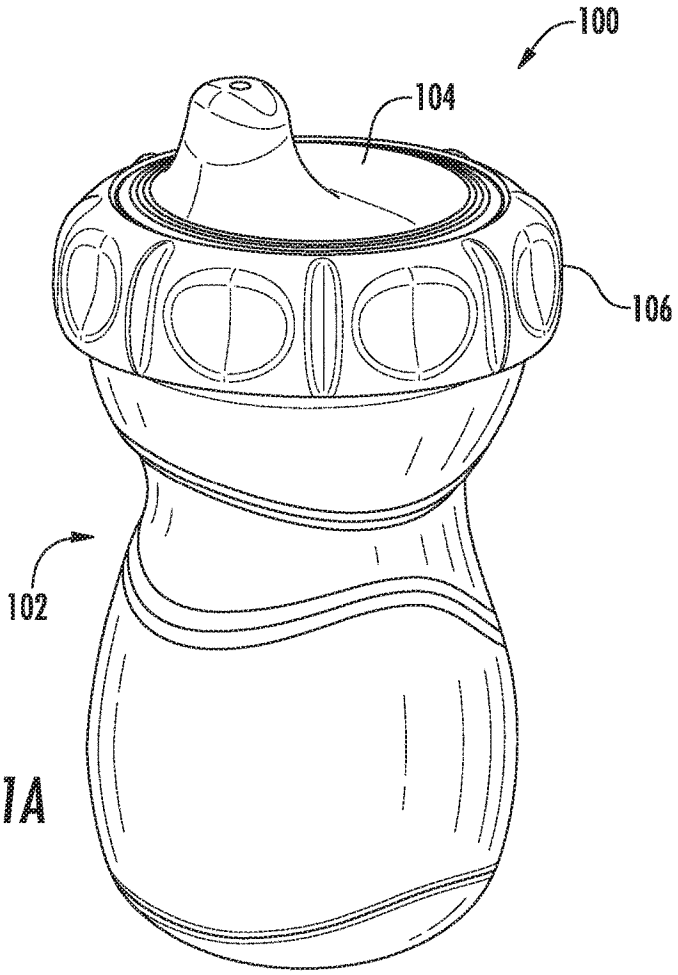
FIG. 1A is a perspective view of a drink container and torque-limiting lid, in accordance with one example embodiment of the disclosure.

FIGS. 1A-1B are perspective and exploded views of a drink container 100 with a torque-limiting lid 103, in accordance with one example embodiment of the disclosure. In certain example embodiments, the drink container can be a child's training cup or sippy cup. The use of the term sealed denotes that the drink container 100 does not leak liquid between the seal between the container body 102 and the lid 103. Referring now to FIGS. 1A-B, the drink container 100 includes a container body 102 and a removable, torque-limiting lid 103 rotatably coupled to the container body 102. In one example, the container body 102 can include a threaded exterior top end 116 and the torque-limiting lid 103 can include a set of threads on an interior surface (see 220 FIG. 2C) that corresponds with and can be rotatably coupled to the threaded exterior top end 116 of the container body 102.

The container body 102 can include a bottom surface 108 and one or more side walls 112 extending up from the bottom surface 108. While the example embodiment of FIG. 1A shows the drink container 100 having a single wall 112 with a circular cross-section, other wall configurations with multiple walls 112 and other cross-sectional shapes, such as oval, square, rectangular, geometric, non-geometric, or abstract, are within the scope of this disclosure. The bottom surface 108 and one or more walls 112 define an enclosure configured to hold liquid, such as drinking fluids.

The container body 102 can also include a container lip 114 disposed along the top edge of the container body 102. The container lip 114 can provide an annular edge along the top end of the container body. In other examples, the container lip 114 can have any other shape. The container lip 114 defines an opening or passageway 110 into the enclosure of the container body 102. The container body 102 can also include one or more threads 116 disposed along an outer surface of the container body 102. In one example the threads 116 can be positioned adjacent and slightly below the container lip 114. The threads 116 can be male or female threads and the thread's size, shape, and disposition can correspond with the threads on the interior surface of the lid 103 (see 220 FIG. 2C).

The container body 102 can have a generally circular main body defined by the one or more side walls 112. While having a generally circular main body, the shape of the container body may include a variable diameter such that the bottom portion and the top portion of the container body 102 have a greater diameter than the middle portion of the container body 102. This variable diameter container body 102 can make the container body 102 easier to grasp and hold by a child. While the example embodiment is described as a drink container 100, in other example embodiments, the container body 102 can be a baby bottle or any other type of container that is constructed and arranged to receive a lid. The enclosure defined by the bottom surface 108 and one or more side walls 112 of the container body 102 can have a volumetric capacity that is less than approximately thirty ounces, more preferably less than approximately twenty ounces and most preferably less than approximately twelve ounces.

In certain example embodiments, the bottom surface 108, one or more side walls 112, threads 116, and container lip 114 are integrally formed together. Further, the bottom surface 108, one or more side walls 112, threads 116, and container lip 114 can be constructed of plastic (e.g., polypropylene, polyethylene or high-density polyethylene using a process such as injection molding), metal, metal alloy, or another material. In certain example embodiments, the container body 102 can also include a grip enhancer 118 provided along the one or more side walls 112. In one example, the grip enhancer 118 can be over-molded to the one or more side walls 112 or can be a flexible band positioned around the one or more side walls 112. Alternatively, the grip enhancer can be one or more of a raised surface, a studded surface, or a friction increasing material applied to the outer surface of a portion of the one or more side walls 112.

The drink container 100 also includes the torque-limiting lid 103. In one example, the torque-limiting lid 103 includes an inner lid assembly 104 and an outer lid assembly 106. In one example, the inner lid assembly is constructed of polybutylene terephthalate (PBT) and the outer lid assembly is constructed of polypropylene. The inner lid assembly 104 can be removably coupled to the outer lid assembly 106. For example, the inner lid assembly 104 can be slidably inserted into the outer lid assembly 106 and at least a portion of the inner lid assembly 104 can extent above a top end of the outer lid assembly 106 and another portion of the inner lid assembly 104 can extend below the top end of the outer lid assembly 106. In one example, when the inner lid assembly 104 is coupled to the outer lid assembly 106, the inner lid assembly 104 is concentric with the outer lid assembly 106 and the outer diameter of the inner lid assembly 104 is less than the outer diameter of the outer lid assembly 106. The inner lid assembly 104 will be discussed in greater detail with regard to FIGS. 2A-D below. The outer lid assembly 106 will be described in greater detail with regard to FIGS. 3A-B below.

Figure 2A:
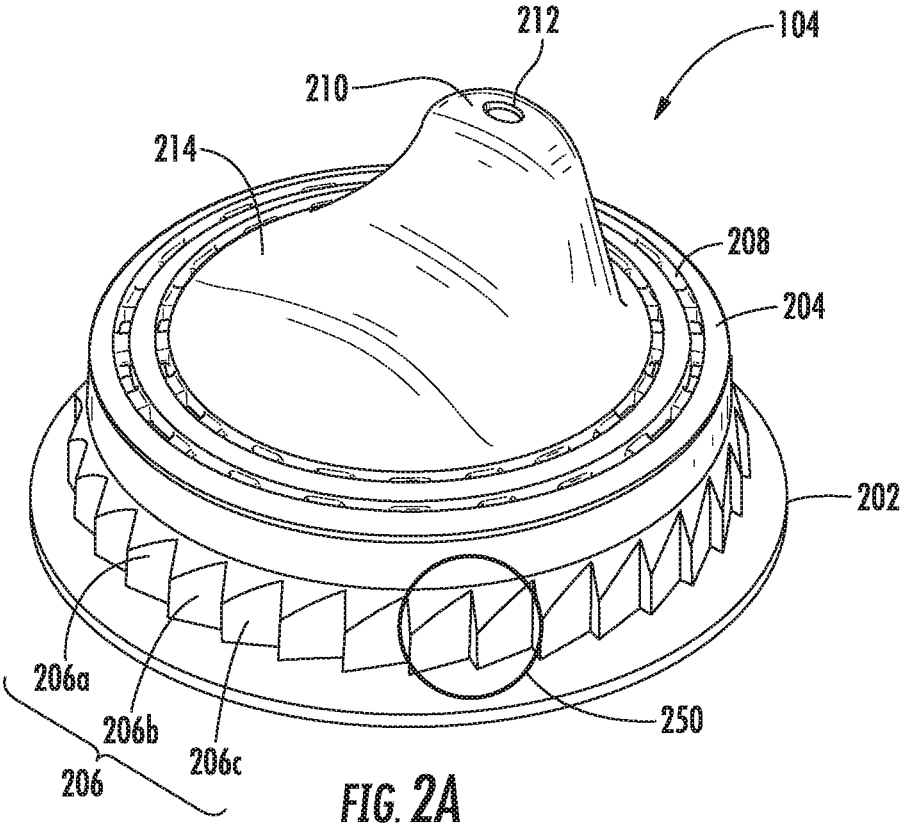
FIG. 2A is a perspective view of an inner lid assembly for the drink container and torque-limiting lid of FIG. 1A, in accordance with one example embodiment of the disclosure.
Figure 2B:
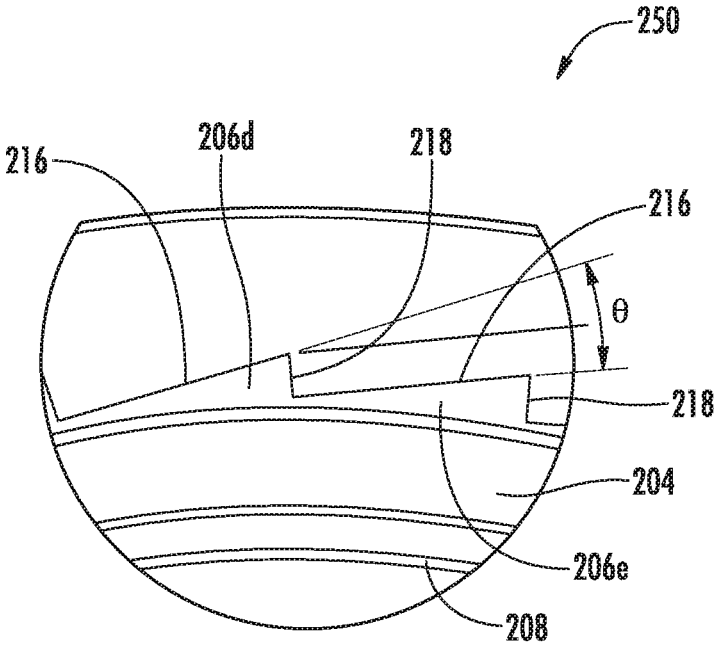
FIG. 2B is a partial top plan view of the inner lid assembly of FIG. 2A, in accordance with one example embodiment of the disclosure.
Figure 2C:
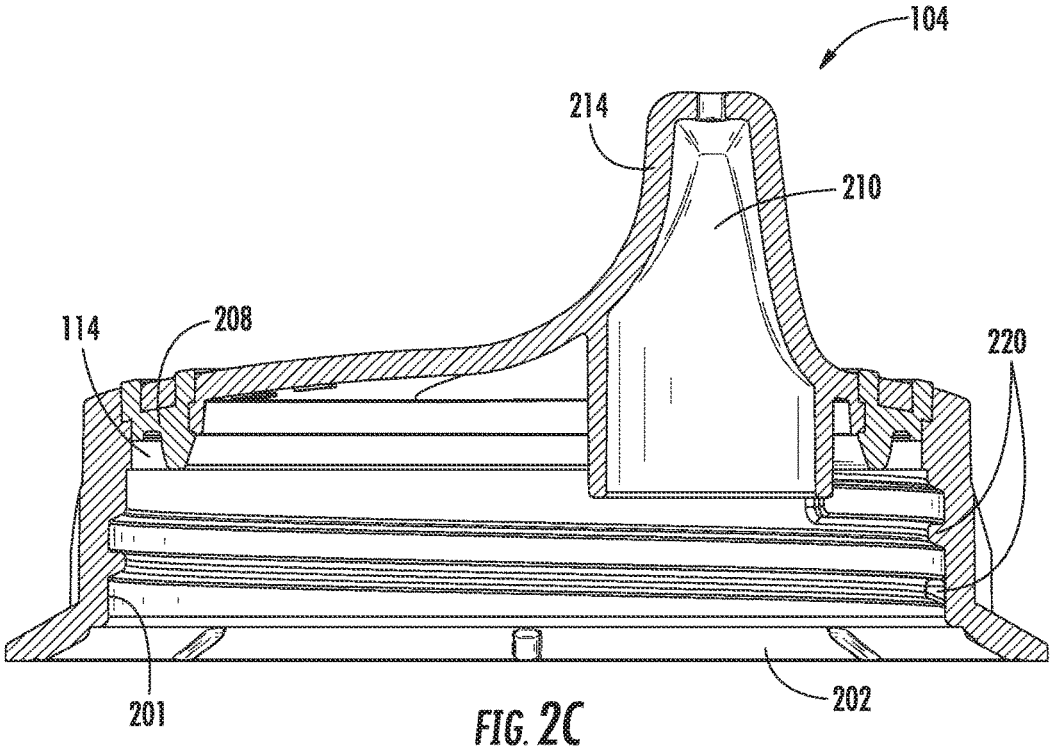
FIG. 2C is a side cross-sectional view of the inner lid assembly of FIG. 2A, in accordance with one example embodiment of the disclosure.

FIGS. 2A-D present various views of the inner lid assembly 104 of the torque-limiting lid 103 of FIG. 1A, in accordance with one example embodiment of the disclosure. Now referring to FIGS. 1A-2D, the example inner lid assembly 104 can include a base 202. In one example, the base 202 can extend generally radially outward from a bottom end of an inner wall 201 of the inner lid assembly, as best seen in FIG. 2C. The inner wall 201 can have an annular shape and can include one or more threads 220 for rotatably coupling the inner lid assembly 104 to the threaded portion 116 of the container body.

The inner lid assembly 104 can also include a top surface 204 and a drinking spout 210 extending generally upward from the top surface 204. The drinking spout 210 can have a variety of shapes and sizes, including, but not limited to, round, oval, elliptical or any other geometric or non-geometric shape. The drinking spout 210 can include a spout opening 212 that provides a passageway that is in fluid communication with the enclosure of the container body 102 when the lid 103 is removably coupled to the container body 102. All or a portion of the top surface 204 and the spout 210 can include a soft cover 214. The soft cover 214 can be made from silicone or another pliable plastic material. In one example, the soft cover 214 can cover a substantial portion of the top surface 204 and can surround the spout 210 below the spout opening 212.

The top surface 204 can also include a sealing means 208 for providing a sealing engagement between the torque-limiting lid 103 and the container body 102 when the lid 103 is rotatably coupled to the container body 102. The sealing means 208 can be any pliable, elastic material, including, but not limited to, a gasket (e.g., an annular gasket), compression seal, or the like. In one example, the sealing means can be made of silicone or any other type of pliable elastic plastic or rubber material. The sealing means 208 can extend down from the top surface into a lid enclosure defined by the inner wall 201, the bottom side of the top surface 204 and optionally the spout 210.

Figure 2D:
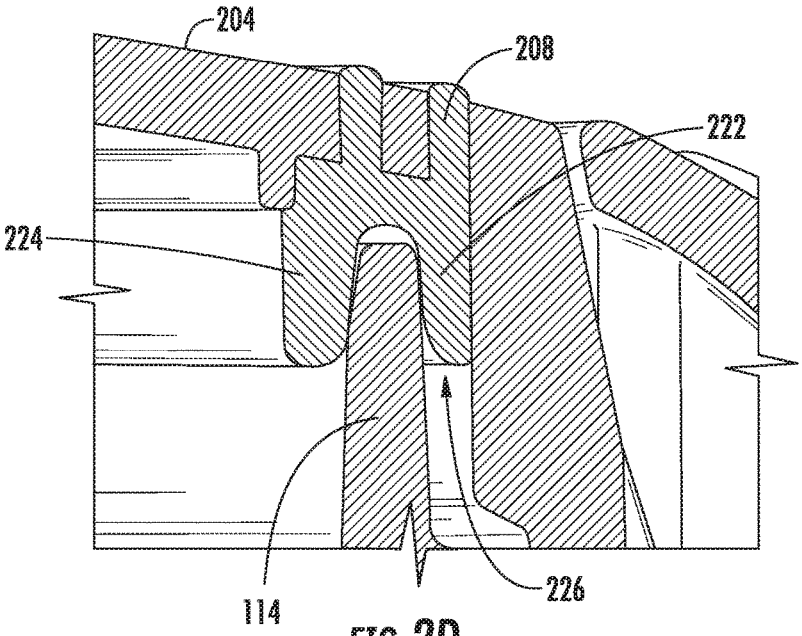
FIG. 2D is a partial side cross-sectional view of the sealing assembly of the inner lid assembly of FIG. 2A engaging the drink container, in accordance with one example embodiment of the disclosure.

In one example, as best viewed in FIG. 2D, the sealing means can include a first sealing arm 222 and a second sealing arm 224 disposed radially inwardly of the first sealing arm 222. Each of the first sealing arm 222 and the second sealing arm 224 can be an annular ring. The first sealing arm 222 can be concentric with the second sealing arm 224. The first sealing arm 222 and the second sealing arm 224 can be spaced apart a predetermined distance to define a channel 226. The channel 226 can be generally U-shaped. The predetermined distance between the first sealing arm 222 and the second sealing arm 224 can be less than or equal to the width of the container lip 114. In one example, the channel 226 is configured to receive at least a portion of the container lip 114 therein. For example, as the container lip 114 enters the channel 226 between the first sealing arm 222 and the second sealing arm 224, one or both of the first sealing arm 222 and the second sealing arm 224 can deflect radially (the first sealing arm 222 radially outward and the second sealing arm 224 radially inward) to slidable receive the container lip 114 into the channel 226 and to provide a snug fit between the container lip 114, the first sealing arm 222 and the second sealing arm 226. In one example, the sealing means 208 is a silicone gasket that is over-molded on to the inner lid assembly 104.

The inner lid assembly can also include multiple ratchet teeth 206*a*, 206*b*, 206*c* . . . (referred to individually and collectively as 206) disposed around an outer periphery of the inner wall 201 and positioned between the base 202 and the top surface 204. In one example, the size and number of ratchet teeth can be configurable based on the size of the inner lid assembly and/or the size and shape of the corresponding ratchet pawl (discussed below). Each ratchet tooth 206 can generally extend out radially outward from the outer surface of the inner wall 201.

FIG. 2B provides a magnified view 250 of a couple of the example ratchet teeth 206*d* and 206*e*. As shown in FIG. 2B, the ratchet teeth 206*d* and 206*e* as well as each of the other ratchet teeth 206 includes a leading edge surface 218 and a rubbing surface 216. In one example, the leading edge surface 218 can extend out from the outer surface of the inner wall 201. In some example embodiments, the leading edge surface 218 can extend from the outer surface of the inner wall at a predetermined angle from a line tangent to the outer surface of the inner wall 201 at the junction of the leading edge surface 218 and the inner wall 201. In one example, the predetermined angle can be in a range of substantially 3 degrees to substantially 20 degrees and preferably in the range of substantially 7 degrees to substantially 15 degrees and more preferably substantially 11 degrees.

Further, the leading edge surface 218 can have a predetermined length that it extends generally radially outward from the adjacent ratchet tooth, 206*d* and 206*e* for example. The predetermined length can be configurable and can vary based on the size and shape of the pawls configured to engage the ratchet tooth 206. In one example, the predetermined length can be within a range of substantially 0.020 inches to substantially 0.150 inches and more preferably within a range of substantially 0.030 inches to substantially 0.10 inches and even more preferably within a range of substantially 0.040 inches to substantially 0.060 inches. In one example, the predetermined length is 0.050 inches. Further, the leading edge surface 218 can have a predetermined leading edge surface outer radius (as measured from the farthest point of the leading edge surface from the centerpoint of the inner lid assembly 104) and a predetermined leading edge surface inner radius (as measured from the nearest point of the leading edge surface 218 from the centerpoint of the inner lid assembly 104). The leading edge surface outer radius and inner radius can each be configurable and can vary based on the size and shape of the pawls configured to engage the ratchet tooth 206. In one example, the leading edge surface outer radius can be substantially 1.36 inches and the leading edge surface inner radius can be substantially 1.31 inches.

The leading edge surface 218 of the ratchet teeth 206 can be configured to contact a second driving surface portion of a pawl on the outer lid assembly 106 when the outer lid assembly 106 is rotated to removably decouple the lid 103 from the container body 102. This contact with the second driving surface portion of the pawl will transfer a rotational force of the outer lid assembly 106 to the inner lid assembly 104 to rotate the inner lid assembly and decouple the decouple the threads 220 of the inner lid assembly 106 from the threaded portion 116 of the container body 102.

The rubbing surface 216 of each of the ratchet teeth 206 can have a first end and a distal second end. The first end can be positioned at and extend from the leading edge surface 216 of the adjacent ratchet tooth 206. For example, as shown in FIG. 2B, the rubbing surface 216 for ratchet tooth 206*e* extends from the junction of the leading edge surface 218 and the outer surface of the inner wall 201 of the ratchet tooth 206*d*. Alternatively, the first end can extend from the leading edge surface 218 of the adjacent ratchet tooth 206. The distal second end can extend to a junction with the leading edge surface 218 for that particular ratchet tooth 206. The rubbing surface 216 can have a flat or substantially flat surface that extends at a predetermined angle (θ) from a line tangent to the outer surface of the inner wall 201 at the junction of the rubbing surface 216 and the inner wall 201. In one example, the predetermined angle (θ) can be in a range of substantially 5 degrees to substantially 20 degrees and preferably in a range of substantially 9 degrees to substantially 15 degrees and more preferably substantially 11 degrees.

The rubbing surface 216 of the ratchet teeth 206 can be configured to contact a first driving surface portion of a pawl on the outer lid assembly 106 when the outer lid assembly 106 is rotated to removably couple the lid 103 to the container body 102. This contact with the first driving surface portion of the pawl will transfer a rotational force of the outer lid assembly 106 to the inner lid assembly 104 to rotate the inner lid assembly 104 to a predetermined torque level. In one example embodiment, the predetermined torque level can be in the range of substantially 5 foot-pounds of force to substantially 30 foot-pounds of force and more preferably substantially 9 foot-pounds of force to substantially 24 foot-pounds of force and even more preferably substantially 12 foot-pounds of force to substantially 18 foot-pounds of force.

Once the predetermined torque level is reached, a portion of the first driving surface will deflect radially outward as the first driving surface portion of the pawl slides along the rubbing surface in the direction of rotation without transferring the rotational force of the outer lid assembly 106 to the inner lid assembly 104. As the first driving surface of the pawl rotates past the leading edge surface 218, the first driving surface will deflect radially inward and contact the next rubbing surface 216 of the adjacent ratchet tooth to create an audible noise that indicates to the user that the proper torque level for the lid 103 has been reached. In one example, each of the rubbing surface 216 and the leading edge surface can be planar or substantially planar.

Figure 3A:
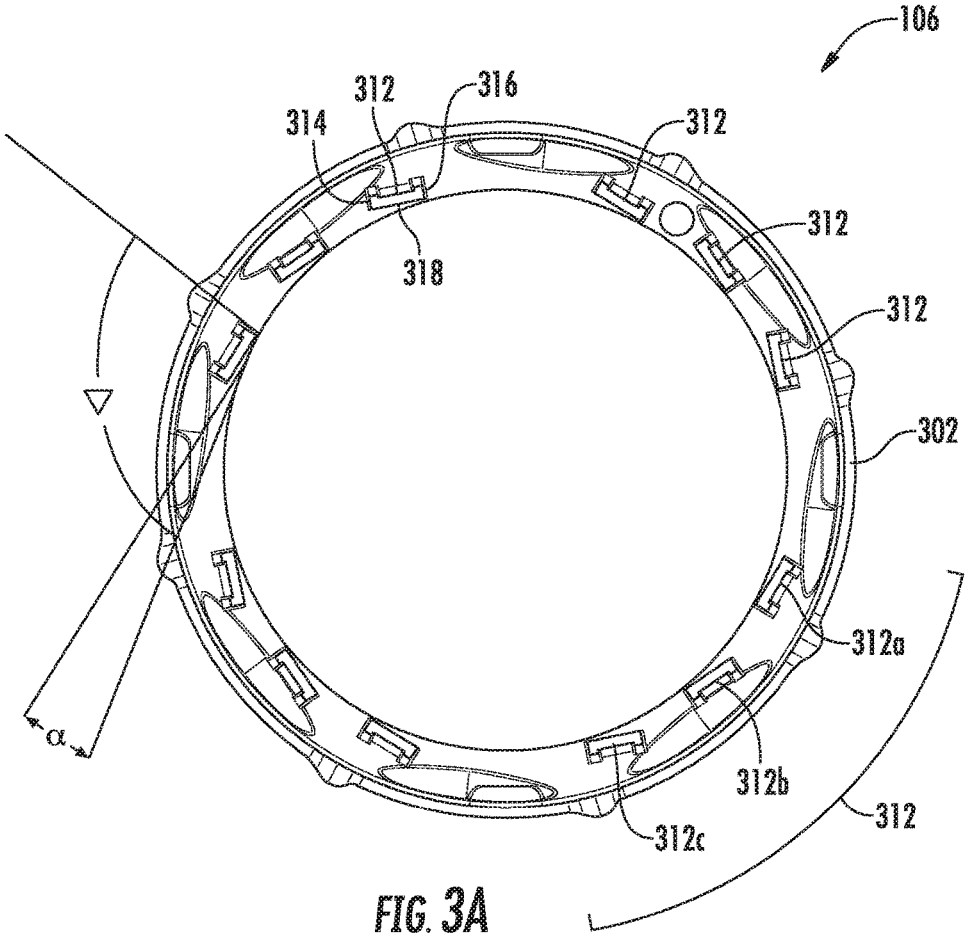
FIG. 3A is a bottom plan view of the outer lid assembly of FIG. 1A, in accordance with one example embodiment of the disclosure.
Figure 3B:
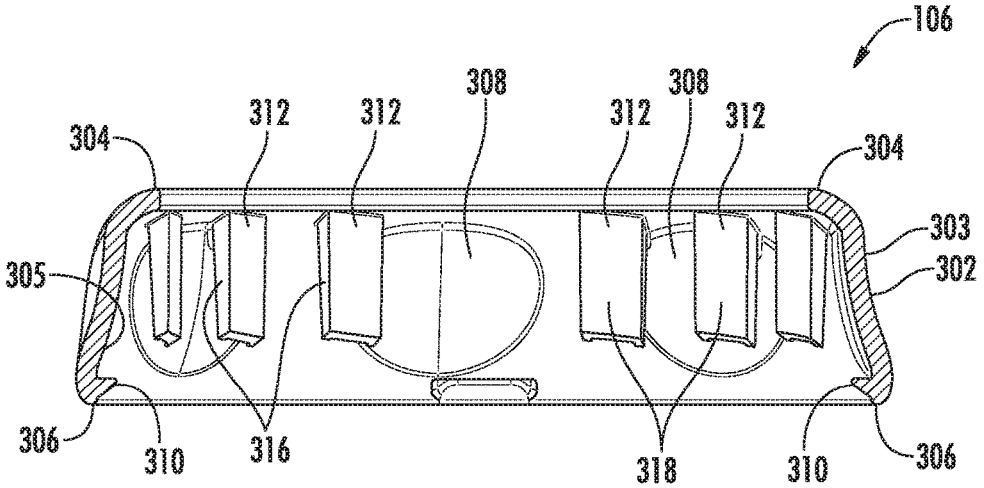
FIG. 3B is a partial side cross-sectional view of the outer lid assembly of FIG. 1A, in accordance with one example embodiment of the disclosure.

FIGS. 3A and 3B are bottom plan and partial side cross-sectional views of the outer lid assembly 106 for the drink container 100 of FIG. 1A, in accordance with one example embodiment of the disclosure. Now referring to FIGS. 1A-3B, the example outer lid assembly 106 can have an annular or substantially annular shape and can include an outer wall 302 that defines an outer diameter for the outer lid assembly 106. The outer wall 302 can include an outer surface 303 and an opposing inner surface 305. The outer surface 303 can include multiple depressions or dimples 308 disposed along the outer periphery of the outer surface 303 to improve grippability of the outer lid assembly 106. In one example, the dimples 308 can be concave or convex with respect to the outer surface 303 of the outer wall 302.

The outer wall 302 can extend from a top end 304 to a distal bottom end 306. The top end 304 of the outer wall 302 can define a top aperture and the bottom end 306 of the outer wall 302 can define a bottom aperture. The top and bottom apertures define a passageway through the outer lid assembly 106 for receiving the inner lid assembly 104 therein and at least partially therethrough. One or more retaining flanges 310 can extend radially inward from the outer wall 302 and can be positioned at or adjacent to the bottom end 306 of the outer wall 302. In one example, multiple retaining flanges 310 can be disposed annularly about the outer wall at or adjacent to the bottom end 306. For example, four retaining flanges 310 can be disposed equidistantly or substantially equidistantly about the perimeter of the inner surface 305 of the outer wall 302. The retaining flange 310 can have an inner diameter that is less than the inner diameter of the outer wall 302 at the bottom end 306. The retaining flange 310 can include a flat or substantially flat top surface that is configured to receive the outer edge of the base 202 of the inner lid assembly 104 thereon when the inner lid assembly 104 is removably coupled to the outer lid assembly 106.

The outer lid assembly 106 can further include multiple ratchet pawls 312*a*, 312*b*, 312*c* . . . (referred to individually and collectively as 312) disposed around an inner periphery of the inner surface 305 of the outer wall 302 and positioned between the top end 304 and the bottom end 306. In one example, the size and number of ratchet teeth 312 can be configurable based on the size of the outer lid assembly 106 and/or the size and shape of the corresponding ratchet teeth 206 on the inner lid assembly 104. Each ratchet pawl 312 can generally extend down from or adjacent from the top end 304 of the outer wall 302 for a distance that is less than the distance from the top end 304 to the bottom end 306 of the outer wall 302. While the example embodiment of FIGS. 3A-B show twelve ratchet pawls 312, the number of ratchet pawls 312 can be two or more. Each ratchet pawl 312 can be elastic and radially inwardly biased to improve contact with the corresponding ratchet teeth 206.

As shown in FIG. 3A, each ratchet pawl 312 includes a leading edge 314, a first driving surface 318 and a second driving surface 316. The first driving surface 318 can be positioned between the second driving surface 316 and the leading edge 314. The first driving surface 318 can have a first end, positioned at the intersection of the leading edge 314 and the first driving surface 318, and a distal second end, positioned at the intersection of the first driving surface 318 and the second driving surface 316. The distance between the first end and the distal second end can be a circumferential length for the first driving surface 318. Each first driving surface 318 can be positioned at an angle (α) to a line tangent to the annular surface of the top end 304 of the outer wall 302. In one example, the angle (α) can be in a range of substantially 3 degrees to substantially 20 degrees and preferably in the range of substantially 7 degrees to substantially 15 degrees and more preferably substantially 11 degrees.

The second driving surface 316 and the leading edge 314 can each extend orthogonally or substantially orthogonally from the first driving surface 318. Each second driving surface 316 can be positioned at an angle (Δ) to a line tangent to the annular surface of the top end 304 of the outer wall 302. In one example, the angle (Δ) can be perpendicular to the angle (α) and can be in a range of substantially 93 degrees to substantially 110 degrees and preferably in the range of substantially 97 degrees to substantially 105 degrees and more preferably substantially 101 degrees. Each of these angles (α) and (Δ) are configurable and adjustable and can be modified based on the corresponding angles for the ratchet teeth 206.

The first driving surface 318 is configured to contact the rubbing surface 216 of an individual ratchet tooth 206 to translate a rotational force from the outer lid assembly 106 to the rubbing surface 216 of the inner lid assembly 104 when the lid is rotated in a first direction to couple or tighten the lid 103 to the container body 102 up to the predetermined torque limit. Once the predetermined torque limit is reached, the first driving surface 318 will slide along the rubbing surface 216 and past the leading edge surface 218 to the next adjacent ratchet tooth 206, where the first driving surface 318 will continue to slide along the rubbing surface 216 of the adjacent tooth. Each time the entirety of the first driving surface 318 rotates past the leading edge surface 218 of the ratchet tooth 206 an audible sound will be generated by a portion of the pawl 312 rotating radially inward to contact the next adjacent rubbing surface 216. This provides both an audible and tactile feedback to the user that the predetermined torque limit for rotatably coupling the lid 103 on the container body 102 has been reached. The sliding of the first driving surface 318 along each rubbing surface 216 of each ratchet tooth 206 once the predetermined torque limit has been reached prevents or substantially limits the translation of rotational force on the outer lid assembly 106 to the inner lid assembly 104 and thereby prevents or substantially limits further tightening of the lid 103 onto the container body.

The second driving surface 316 is configured to contact and translate a rotational force from the outer lid assembly 106 to the leading edge surface 218 of the inner lid assembly 104 without slippage or torque limiting when the outer lid assembly 106 is rotated in a second direction to decouple or loosen the lid 103 from the container body 102.

Further, the second driving surface 316 can have a radial length that extends generally radially outward. The radial length can be configurable and can vary based on the size and shape of the leading edge surface 218 of the ratchet teeth 206 configured to be engaged by the ratchet pawl 312. In one example, the radial length can be equal or substantially equal to the length of the leading edge surface 218 and can be within a range of substantially 0.020 inches to substantially 0.150 inches and more preferably within a range of substantially 0.030 inches to substantially 0.10 inches and even more preferably within a range of substantially 0.040 inches to substantially 0.060 inches. In one example, the radial length of the second driving surface 316 is 0.050 inches. The circumferential length of the first driving surface 318 can be greater than the radial length of the second driving surface 316. Further, the second driving surface 316 can have a second driving surface inner radius (as measured from the nearest point of the second driving surface 316 from the centerpoint of the outer lid assembly 106). The second driving surface inner radius can be configurable and can vary based on the size and shape of the ratchet teeth 106 configured to be engaged by the ratchet pawls 312. In one example, the second driving surface inner radius is less than the leading edge inner radius and outer radius, which causes the ratchet pawl 312 to maintain contact with the ratchet teeth 206 and cause the ratchet pawl 312 to momentarily deform (as the radius increases from one end of the rubbing surface to another towards the leading edge surface 218) to pass by the leading edge surface 218 and elastically return to its original shape and be positioned along the rubbing surface 216 of the next adjacent tooth 206. In one example, the second driving surface inner radius can be substantially 1.30 inches. In one example, each of the first driving surface 318 and the second driving surface 316 can be planar or substantially planar.

Figure 4:
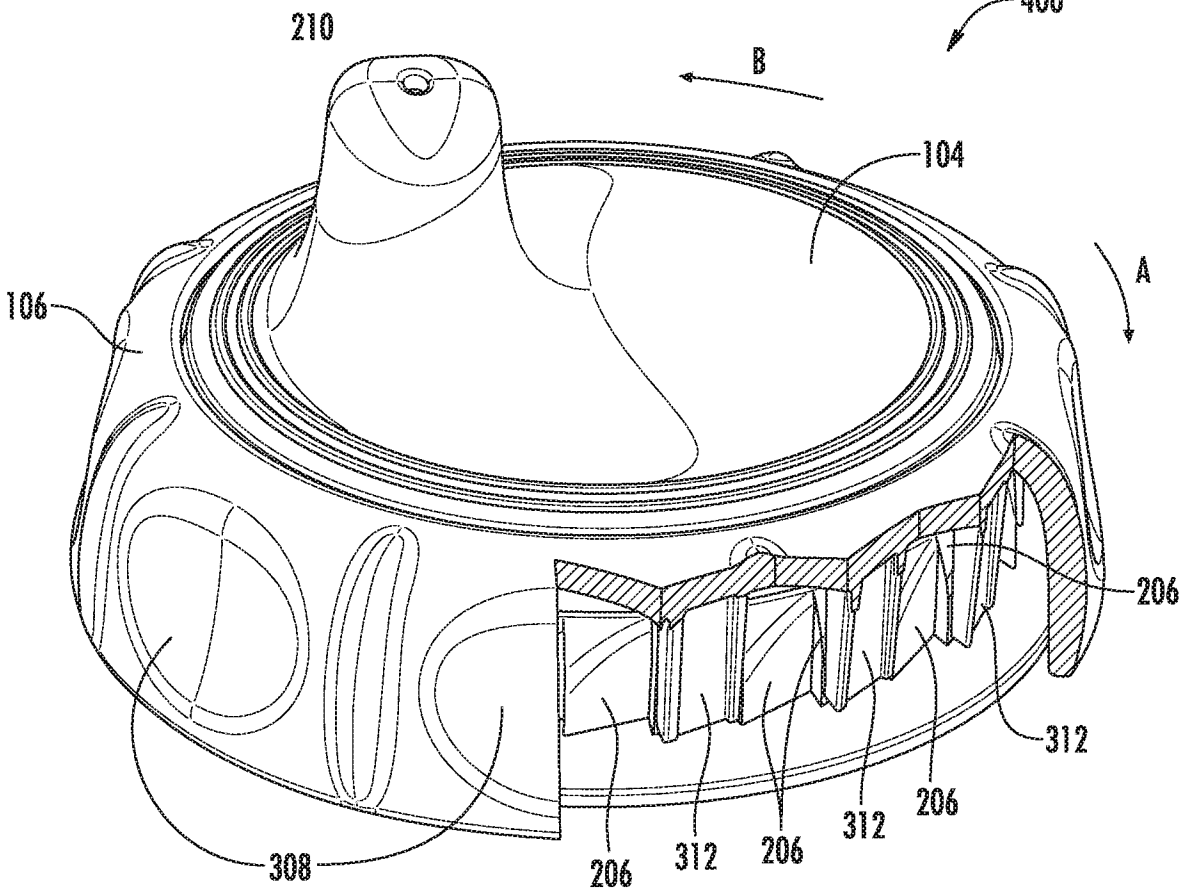
FIG. 4 is a partial cross-sectional view of the inner lid assembly and the outer lid assembly of FIG. 1A, in accordance with one example embodiment of the disclosure.

FIG. 4 is a partial cross-sectional view of the inner lid assembly 104 and the outer lid assembly 106 of the drink container 100 of FIG. 1A, in accordance with one example embodiment of the disclosure. Referring now to FIGS. 1A-4, the inner lid assembly 104 is removably coupled to the outer lid assembly 106 by inserting the inner lid assembly 104 through the bottom aperture defined by the bottom end 306 of the outer wall 302 of the outer lid assembly 106. The spout 210 extends above the top aperture defined by the top end 304 of the outer wall 302. A partial cut-away of the outer wall 302 shows an example of how the ratchet pawls 312 engage the ratchet teeth 206. The number of ratchet pawls 312 can be less than the number of ratchet teeth 206, such that not every tooth 206 is in contact with a corresponding ratchet pawl 312.

As can be seen in FIG. 4 (with reference to FIGS. 2A-3B), the first driving surface 318 of the outer lid assembly 106 can be positioned along the rubbing surface 216 of the inner lid assembly 104 when the lid 103 is not being rotated. As the user rotates the outer lid assembly 106 in the direction A, the first driving surface 318 contacts the rubbing surface 216 of an individual ratchet tooth 206. The frictional force of the first driving surface 318 on the rubbing surface 216 allows the first driving surface 318 to translate the rotational force provided by the user from the outer lid assembly 106 to the rubbing surface 216 of the inner lid assembly 104 to rotate the inner lid assembly 104 in the direction A to couple or tighten the lid 103 to the container body 102 up to the predetermined torque limit. In one example embodiment, the predetermined torque limit can be in the range of substantially 5 foot-pounds of force to substantially 30 foot-pounds of force and more preferably substantially 9 foot-pounds of force to substantially 24 foot-pounds of force and even more preferably substantially 12 foot-pounds of force to substantially 18 foot-pounds of force.

Once the predetermined torque limit is reached between the inner lid assembly 104 and the container body 102 (by way of threadably coupling the threads 116 and 220), the torque between the inner lid assembly 104 and the container body is greater than the friction between the first driving surface 318 and the rubbing surface 216 and the first driving surface 318 will slide along the rubbing surface 216 and flex radially outward past the leading edge surface 218 to the next adjacent ratchet tooth 206, where the first driving surface 318 will continue to slide along the rubbing surface 216 of each subsequent tooth 206 about the outer periphery of the inner lid assembly 104. Each time the entirety of the first driving surface 318 rotates past the leading edge surface 218 of one of the ratchet teeth 206, an audible sound will be generated by a portion of the pawl 312 elastically returning to its original position by having a portion that adjusts radially inward to contact the next adjacent rubbing surface 216. This provides both an audible snapping sound (caused by the first driving surface 318 contacting the rubbing surface 216) and tactile feedback to the user that the predetermined torque limit for rotatably coupling the lid 103 on the container body 102 has been reached. The sliding and radially outward flexing of the first driving surface 318 along each rubbing surface 216 of each ratchet tooth 206 once the predetermined torque limit has been reached prevents or substantially limits the translation of additional rotational force in the direction A from the outer lid assembly 106 to the inner lid assembly 104 and thereby prevents or substantially limits further tightening of the lid 103 onto the container body. This allows the lid 103 to be coupled to the container body 102 at the proper torque level and prevents damage to the sealing gasket 208.

When a user wants to decouple or loosen the lid 103 from the container body 102, the user can rotate the outer lid assembly 106 in the direction B. As the outer lid assembly is rotated in the direction B, the second driving surface 316 contacts the leading edge surface 218 of the inner lid assembly 104. The second driving surface 316 translates a rotational force in the direction B from the outer lid assembly 106 to the leading edge surface 218 of the inner lid assembly 104 without slippage or torque limiting to rotate the inner lid assembly 104 in the direction B to decouple or loosen the lid 103 from the container body 102. In one example, the direction B is counter-clockwise and the direction A is clockwise. However, in other embodiments the directions A and B can be reversed.

While the example embodiment of FIGS. 1A-4 describe a system wherein the inner lid assembly 104 includes ratchet teeth 206 and the outer lid assembly 106 includes ratchet pawls 312, in other example embodiments, this could be reversed such that the outer lid assembly 106 could include ratchet teeth and the inner lid assembly 104 could include ratchet pawls substantially as described herein. Further, while the example embodiment is described with reference to a child's drink container, such as a training cup or sippy cup, this is also for example only as the concepts described herein may be incorporated into any type of cup that includes a lid that is threadably coupled to the container body of the cup.

Though the disclosed example includes a particular arrangement of a number of parts, components, features, and aspects, the disclosure is not limited to only that example or arrangement. Any one or more of the parts, components, features, and aspects of the disclosure can be employed alone or in other arrangements of any two or more of the same.

Although certain drink container features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A drink container comprising:
a container body defining an enclosure;
a lid configured to be threadably coupled to the container body, the lid comprising:
an inner lid assembly comprising:
a wall;
at least one thread disposed along an inner surface of the wall;
a plurality of ratchet teeth disposed along an outer periphery of an outer surface of the wall;
a top surface; and
a spout extending up from the top surface, wherein the spout is fluidicly coupled to the enclosure of the container body,
an outer lid assembly concentric with the inner lid assembly and comprising:
an outer wall; and
a plurality of ratchet pawls disposed along an inner surface of the outer wall, wherein each of the plurality of ratchet pawls contacts a corresponding one of the plurality of ratchet teeth.

2. The drink container of claim 1, wherein the inner lid assembly is removably coupled to the outer lid assembly.

3. The drink container of claim 2,
wherein the inner lid assembly further comprises:
a base; and
a top surface, wherein the wall extends from the base to the top surface;
wherein the outer lid assembly further comprises at least one retaining flange extending radially inward from the outer wall;
wherein the base contacts the retaining flange when the inner lid assembly is coupled to the outer lid assembly.

4. The drink container of claim 3, wherein the plurality of ratchet teeth are disposed between the base and the top surface of the inner lid assembly.

5. The drink container of claim 3, wherein the wall and the top surface define a cavity of the inner lid assembly and wherein the inner lid assembly further comprises a sealing gasket extending down from the top surface and within the cavity of the inner lid assembly, wherein the sealing gasket is configured to engage a container lip defining an opening of the container body.

6. The drink container of claim 1, wherein each of the plurality of ratchet teeth comprises:
a rubbing surface; and
a leading edge surface.

7. The drink container of claim 6, wherein the rubbing surface comprises a first end and a distal second end, wherein the first end is disposed against a second leading edge surface of an adjacent ratchet tooth of the plurality of ratchet teeth and the second end is disposed at a junction with the leading edge surface.

8. The drink container of claim 6, wherein each of the plurality of ratchet pawls comprises:
a first driving surface configured to contact the rubbing surface when the outer lid assembly rotates in a first direction; and
a second driving surface configured to contact the leading edge surface when the outer lid assembly rotates in a second direction opposite the first direction.

9. The drink container of claim 1, wherein the outer lid assembly is rotatable with respect to the inner lid assembly.

10. A drink container comprising:
a container body comprising:
an enclosure;
an annular container lip defining an opening to the enclosure;
at least one thread disposed along an outer surface of the container body adjacent to the container lip;
a lid configured to be threadably coupled to the container body, the lid comprising:
an annular inner lid assembly comprising:
a base;
a top surface;
a wall extending between the base and the top surface; and
a plurality of ratchet teeth disposed along an outer surface of the wall wherein each of the plurality of ratchet teeth comprises:
a planar rubbing surface having a first end and a distal second end; and
a planar leading edge surface, wherein the first end is disposed against a second leading edge surface of an adjacent ratchet tooth of the plurality of ratchet teeth and the second end is disposed at a junction with the planar leading edge surface;
an annular outer lid assembly movably coupled to and concentric with the inner lid assembly and comprising:
an outer wall;
a plurality of ratchet pawls annularly disposed about an inner surface of the outer wall.

11. The drink container of claim 10, wherein the wall and the top surface define a cavity of the inner lid assembly and wherein the inner lid assembly further comprises a sealing member extending down from the top surface and within the cavity of the inner lid assembly, wherein the sealing member is configured to engage the container lip when the lid is threadably coupled to the container body.

12. The drink container of claim 10, wherein each of the plurality of ratchet pawls comprises:
a planar first driving surface configured to contact the planar rubbing surface when the outer lid assembly rotates in a first direction; and
a planar second driving surface configured to contact the planar leading edge surface when the outer lid assembly rotates in a second direction opposite the first direction.

13. The drink container of claim 10, wherein each of the plurality of ratchet pawls is elastic.

14. The drink container of claim 10, wherein each of the plurality of ratchet pawls is radially inwardly biased.

* * * * *